US007900404B2

(12) United States Patent
Koch et al.

(10) Patent No.: US 7,900,404 B2
(45) Date of Patent: Mar. 8, 2011

(54) COMBINATION FLASHING AND DRAINAGE SYSTEM

(75) Inventors: David G. Koch, Mableton, GA (US); Joseph G. Lincourt, Sanford, ME (US); Kevin D. Broad, Sanford, ME (US)

(73) Assignee: York Manufacturing, Inc., Sanford, ME (US)

( * ) Notice: Subject to any disclaimer, the term of this patent is extended or adjusted under 35 U.S.C. 154(b) by 1887 days.

(21) Appl. No.: 10/710,845

(22) Filed: Aug. 6, 2004

(65) Prior Publication Data

US 2005/0028455 A1 Feb. 10, 2005

Related U.S. Application Data

(60) Provisional application No. 60/481,191, filed on Aug. 7, 2003.

(51) Int. Cl.
*E04D 3/38* (2006.01)

(52) U.S. Cl. ..... 52/62; 52/169.5; 52/302.6; 52/379

(58) Field of Classification Search ..... 52/513, 52/169.5, 169.14, 58, 60, 61, 62, 302.1, 602.6, 52/232, 379; 442/239; 49/13
See application file for complete search history.

(56) References Cited

U.S. PATENT DOCUMENTS

| | | | | |
|---|---|---|---|---|
| 2,005,221 | A | 6/1935 | Cohen et al. | 72/127 |
| 3,497,417 | A * | 2/1970 | Rizzo | 428/608 |
| 3,498,015 | A * | 3/1970 | Green et al. | 52/310 |
| 3,654,765 | A * | 4/1972 | Healy et al. | 405/45 |
| 3,946,762 | A * | 3/1976 | Green | 405/45 |
| 4,572,700 | A * | 2/1986 | Mantarro et al. | 404/35 |
| 5,343,661 | A | 9/1994 | Sourlis | 52/169.5 |
| 5,937,594 | A | 8/1999 | Sourlis | 52/169.5 |
| 6,023,892 | A * | 2/2000 | Sourlis | 52/169.5 |
| RE36,676 | E | 5/2000 | Sourlis | 52/169.5 |
| 6,550,190 | B2 * | 4/2003 | Ruiz et al. | 52/169.5 |
| 6,581,402 | B2 * | 6/2003 | Maisotsenko et al. | 62/315 |
| 6,584,746 | B1 | 7/2003 | Hohmann et al. | 52/513 |
| 6,696,141 | B2 * | 2/2004 | Lolley et al. | 428/212 |
| 6,928,780 | B1 | 8/2005 | Hohmann et al. | 52/513 |
| 6,964,136 | B2 * | 11/2005 | Collins et al. | 52/209 |
| 2002/0115367 | A1 * | 8/2002 | Lolley et al. | 442/6 |
| 2002/0152696 | A1 * | 10/2002 | Ruiz et al. | 52/169.5 |

OTHER PUBLICATIONS http://web.archive.org/web/20020602134312/www.yorkmfg.com/default.asp?linknum=27.*

* cited by examiner

*Primary Examiner* — Brian E Glessner
*Assistant Examiner* — William V Gilbert
(74) *Attorney, Agent, or Firm* — Mesmer & Deleault, PLLC

(57) ABSTRACT

A combination through-wall masonry flashing/drainage device having a flashing membrane with at least one reinforcing cloth adhered to at least one side of the flashing membrane. A wicking cloth made of a synthetic wicking material is then adhered to the device. The wicking cloth material is selected for wicking ability, life expectancy, mildew resistance, and strength characteristics.

21 Claims, 2 Drawing Sheets

COMBINATION FLASHING AND DRAINAGE SYSTEM

CROSS-REFERENCES TO RELATED APPLICATIONS

This application claims the benefit of U.S. Provisional Application No. 60/481,191, filed Aug. 7, 2003.

BACKGROUND OF INVENTION

1. Field of the Invention

The invention is related to multi-layer flashing systems for masonry.

2. Description of the Related Art

Traditionally, a masonry cavity wall is constructed having an inner back-up wall made of concrete, masonry block, brick, wood or steel frame construction, and an outer veneer wall of brick, stone, block, stucco, or other masonry. The two walls are separated by an air space or cavity. The width of this cavity can be specified by building code or architectural design preference. The purpose of this type of design, two walls separated by a cavity, is to prevent water from reaching the interior of the building as well as for its insulation value. As water penetrates the outer wall or "wythe", it collects and condenses on the inner face of the outer wall. It runs down this surface to a point where its downward flow is interrupted by a horizontal plane such as a window, door, shelf angle, lintel, or the base of the wall itself. At these points, the water is diverted out of the wall by the through-wall flashing and weep devices which are placed in such a manner as to maximize the evacuation of the water. Weep devices can be metal or plastic tubes, ropes, and other devices.

Ideally, the flashing is affixed to the back-up wall by any of several methods. One method is to insert the flashing into a horizontal joint, if the back-up wall is a masonry block wall. Another method is to insert the flashing into a reglet, which is a horizontal slot placed in a poured concrete back-up wall. Yet another method is to mechanically fasten the flashing to the backup wall with screws and a termination bar. A termination bar is a strip of metal or plastic with evenly spaced holes for screws designed to spread the load evenly across the width of the bar. This may be used on any kind of back-up wall.

The flashing runs down the face of the back-up wall to a horizontal ledge or shelf. Then it turns and runs horizontally out and through the brick veneer, forming a continuous sheet that guides any water out of the wall and prevents any water from reaching the interior of the building. This flashing was traditionally made of heavy gauge copper or lead sheet that required trained metal workers to install correctly. Laps and seams needed to be soldered, which is difficult to do properly and in a watertight fashion.

One solution to this problem is disclosed in U.S. Pat. No. 2,005,221, which is not admitted to being prior art by its inclusion in this Background section. In that patent, a copper flashing is provided with a waterproofed fabric adhered to it. However, it cannot wick water away because it is waterproof by definition.

Another problem that appears in through-wall flashing/cavity wall construction is that, as the wall is built, excess mortar from subsequent layers of brick falls into the cavity and blocks the weep openings or ropes, which can render these very important components of this system inoperable. One solution to this problem was disclosed in U.S. Pat. No. RE36,676, which is not admitted to being prior art by its inclusion in this Background section. The solution to place something in the cavity that would allow water to migrate through to the weeps, yet prevent mortar and debris from clogging these openings. Other solutions, like using pea-stone gravel or a plastic mesh unit, are still in use today.

These cavity filling devices, both gravel and plastic, have deficiencies. The gravel is heavy and difficult to transfer to higher levels of scaffolding, which leads to it being omitted. There are also claims that, because of its density in the cavity, it allows the mortar to fill up the cavity, thereby defeating the purpose. The plastic mesh products, commonly marketed under the MORTAR NET and MORTAR BREAK trademarks, are quite expensive, often costing more than the flashing itself.

This has led to the need for a product that eliminates the need for other products, is easy to install, and performs as well or better as other products which, when combined, serve the same purpose, that of allowing the free flow of water from a masonry wall cavity.

SUMMARY OF INVENTION

The new product combines the durability, flexibility, and ease of installation of traditional copper fabric flashing, with an attractive drainage method, namely a thin, virtually invisible and effective cavity drainage system. All of this is provided in a single, easy to install, relatively inexpensive product.

DETAILED DESCRIPTION

Figure 1:
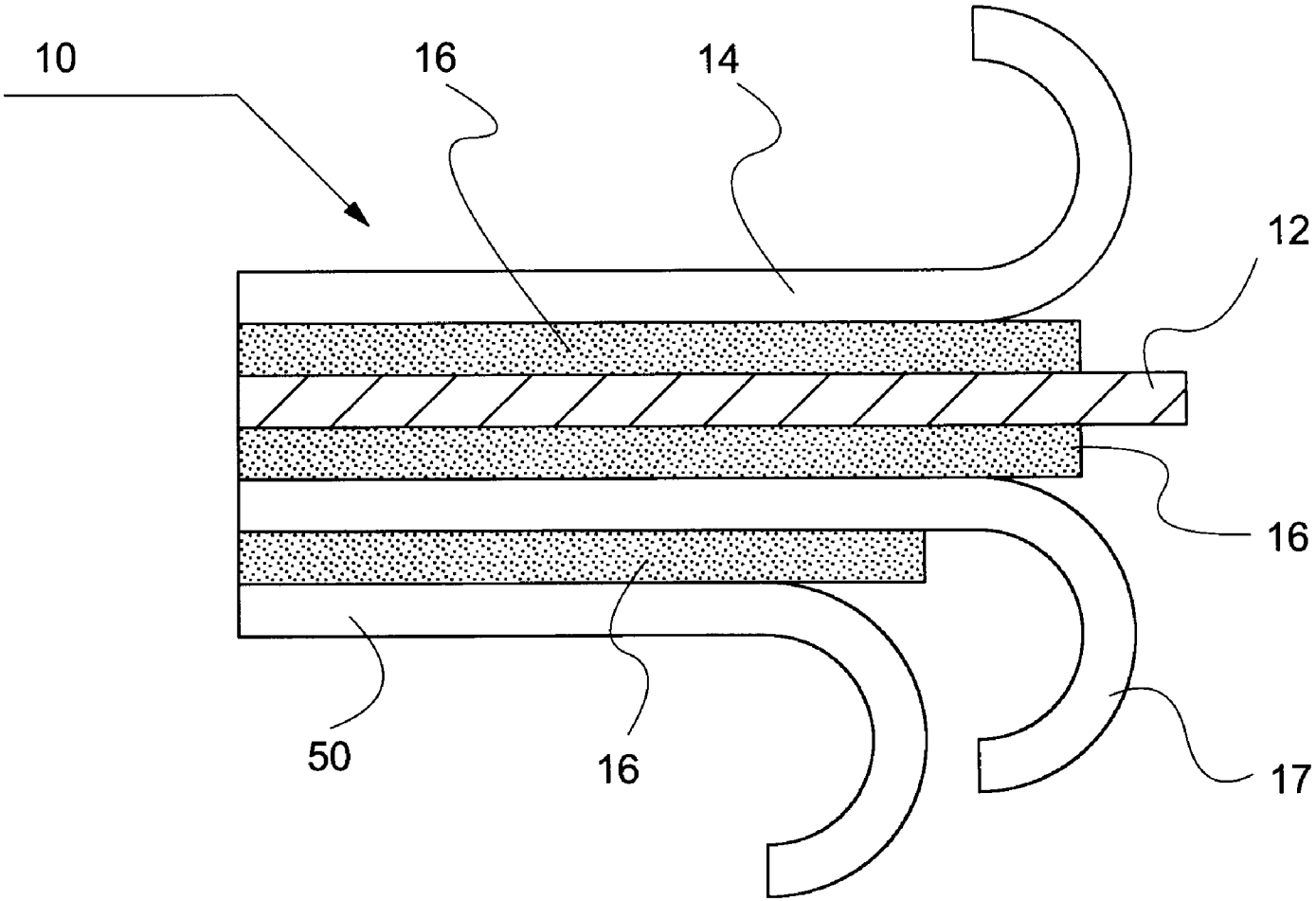
FIG. 1 shows the components of a multiple layer combination flashing and drainage system according to the present invention.

The invention is a combination through-wall masonry flashing/drainage device 10. Turning to FIG. 1, a single sheet of flashing membrane 12 is preferably at the core of the device 10. Examples of suitable flashing membrane material include, without limitation, copper, PVC, polyethylene, and stainless steel sheet. The sheet of flashing membrane, if copper is used, preferably conforms to ASTM B-370, weighs 3 to 7 ounces/square foot, and is between 0.0036 inches and 0.0094 inches thick.

A first reinforcing cloth 14 is adhered to a first side of the flashing membrane 12 using an adhesive 16. The adhesive 16 is preferably a hot-melt type of adhesive, and is either rubber or latex. The reinforcing cloth 14 is preferably made of fiberglass and can be woven or non-woven, but preferably weighs between 0.2 and 0.3 ounces/square foot. Other natural or synthetic fabrics could also be used instead of fiberglass.

Optionally, a second reinforcing cloth 17 may be provided and adhered to a second side of the flashing membrane 12 with a layer of adhesive 16. The second reinforcing cloth 17 would be the same material as the first reinforcing cloth 14. The purpose of the reinforcing cloth 14, 17 is both to reinforce and protect the flashing membrane during installation, and to provide a rough textured surface that promotes bonding in the mortar joint.

A wicking cloth 50 is provided and adhered to the second side of the flashing membrane 12 with an adhesive 16. If a second reinforcing cloth 17 was provided, then the wicking cloth 50 is adhered to the outside of the second reinforcing cloth 17. Otherwise, the wicking cloth is adhered directly to the flashing membrane 12 with a layer of adhesive 16. The wicking cloth 50 is made of either polyester, polypropylene, polypropylene nylon, or polyethylene. The material preferably 0.050 inches thick, and weighs between five and seven ounces/square yard. The wicking cloth 50 can be either woven or non-woven. A synthetic fiber material is preferred for long life, mildew resistance, and strength. The primary criterion is the cloth has suitable wicking characteristics.

Materials and devices used previously do not have wicking material that runs the length of the front joint of an outside wall, as the present invention does. The previous materials and devices relied only on gravity to transport water from between an inside and outside wall through weep vents in the outside wall. The present invention uses wicking in addition to gravity to transport water through the mortar joint without a weep vent. To emphasize the technical difference between the two liquid transport methods, wicking is the absorption of liquid into a material by capillary action. Wicking is also known as fiber tow infiltration.

This product would preferably be manufactured as a continuous web on a double-sided, extrusion slot-die, coater/laminator. The flashing membrane base material 12 is fed into the machine where it passes over the first of two slot die extruders. The adhesive 16 is extruded in a continuous sheet/film and applied through contact to one side of the membrane. The first reinforcing cloth 14 is immediately introduced and pressed into the adhesive 16 by a series of rolls. The now three-layer product continues through the machine to such a point as the opposite side passes over the second slot die. Adhesive 16 is extruded and the second cloth, either reinforcing or wicking, and is applied in the same manner as the first, but to the opposite side of the flashing membrane 12. If a third layer of cloth 50 is to be applied, i.e. two layers of reinforcing material and one layer of wicking material, the web would have to be passed through the machine a second time.

As an alternative, the product could also be made as a self-adhesive product, combining a self-adhesive roofing underlayment style membrane with the wicking fabric on the outer surface. This roofing underlayment would be best described in ASTM standards D 6164-00 and D 1970-01 with the "top surface" being the wicking fabric.

Figure 2:
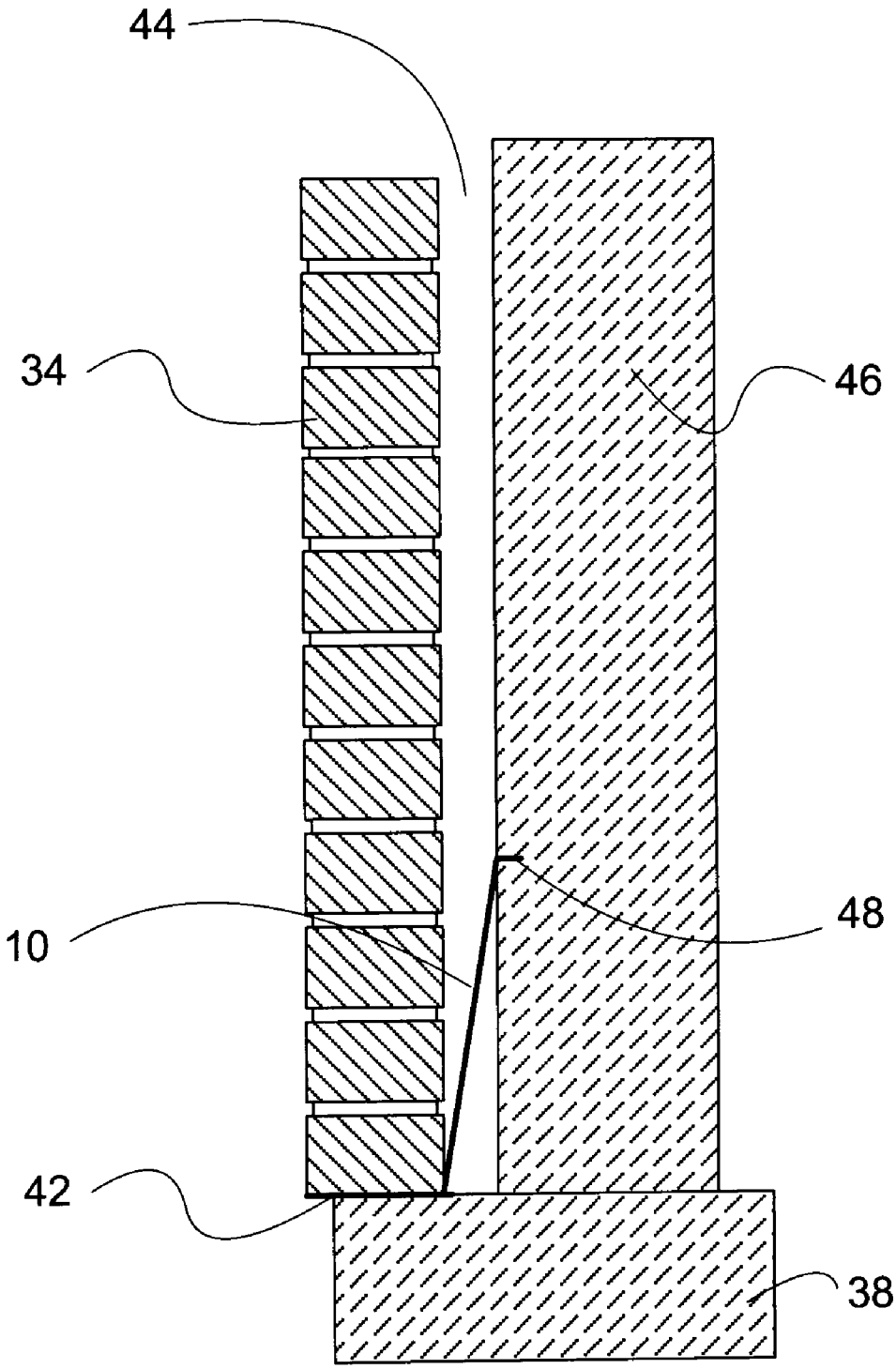
FIG. 2 is a cut-away view of a masonry wall showing how the invention is used.

FIG. 2 shows an example of how the device 10 can be used. A two-inch cavity structure 44 has an upstanding front brick wall 34 and a back concrete wall 46 supported on a horizontal concrete support 38, wherein about a two inch cavity is between the front and back walls. The through-wall masonry flashing/drainage device 10 is shown as secured in a reglet 48 of the back concrete wall 46 bonded mechanically within the reglet 48. The flashing material extends downwardly within the two inch cavity 44 and exits at the front mortar joint 42, permitting trapped water to be released to the outside of the structure without the need for vents.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

The invention claimed is:

1. A combination through-wall masonry flashing/drainage device comprising a flashing membrane, the flashing membrane having a first side and a second side opposite the first side, a reinforcing cloth adhered to the flashing membrane first side, and a wicking cloth adhered to the flashing membrane second side, whereby when installed between an inner wall and outer wall with the wicking cloth facing up, water between the inner wall and outer wall is drawn through a mortar joint at the base of the outer wall to the outside of the outer wall by the wicking action of the wicking cloth without the need for vents.

2. The device of claim 1, wherein the flashing membrane is a sheet of copper material.

3. The device of claim 1, wherein the flashing membrane is made of copper sheet weighing between three and seven ounces per square foot and is between 0.0036 and 0.0094 inches thick.

4. The device of claim 1, wherein the reinforcing cloth is fiberglass.

5. The device of claim 4, wherein the reinforcing cloth weighs between 0.2 and 0.3 ounces per square foot.

6. The device of claim 1, wherein the wicking cloth is made of a synthetic fiber material selected for maximum wicking ability, life expectancy, mildew resistance, and strength characteristics, is about 0.050 inches thick, and weighs between five and seven ounces per square yard.

7. The device of claim 1, wherein the wicking cloth material is one taken from the group consisting of polyester, polypropylene, polypropylene nylon, and polyethylene.

8. The device of claim 1, wherein the wicking cloth transports liquid by capillary action or fiber tow infiltration.

9. The device of claim 8, wherein the wicking cloth transports liquid by both capillary action and gravity.

10. The device of claim 1 further comprising an adhesive disposed between the reinforcing cloth and the flashing membrane, and between the wicking cloth and the flashing membrane.

11. A combination through-wall masonry flashing/drainage device comprising a flashing membrane, the flashing membrane having a first side and a second side opposite the first side, a first reinforcing cloth adhered to the flashing membrane first side, a second reinforcing cloth adhered to the flashing membrane second side, and a wicking cloth adhered to the second reinforcing cloth, wherein the wicking cloth material is selected from the group consisting of polyester, polypropylene, polypropylene nylon, and polyethylene, whereby when installed between an inner wall and outer wall with the wicking cloth facing up, water between the inner wall and outer wall is drawn through a mortar joint at the base of the outer wall to the outside of the outer wall by the wicking action of the wicking cloth without the need for vents.

12. The device of claim 11, wherein the wicking cloth transports liquid by capillary action or fiber tow infiltration.

13. The device of claim 12, wherein the wicking cloth also transports liquid by gravity.

14. The device of claim 11 further comprising an adhesive disposed between the reinforcing cloths and the flashing membrane, and between the wicking cloth and the second reinforcing cloth.

15. A system for removing water from between an inner wall and an outer wall comprising an inner wall, an outer wall, and a combination through-wall masonry flashing and drainage device, the device comprising a flashing membrane having a first side and a second side opposite the first side, a reinforcing cloth adhered to the flashing membrane first side, and a wicking cloth adhered to the flashing membrane second side; the device having a first edge and a second edge opposite the first edge, wherein the first edge of the device is secured to the inner wall with the wicking cloth facing up, and the second edge of the device is secured beyond the outer wall, such that water between the inner wall and outer wall is drawn through a mortar joint at the base of the outer wall to the outside of the outer wall by the wicking action of the wicking cloth without the need for vents.

16. The system of claim 15, wherein the first edge is secured at a higher elevation on the inner wall than the second edge is secured to the outer wall.

17. The system of claim 15, further comprising a horizontal concrete support upon which the inner wall and outer wall are supported, wherein the device second edge is disposed between and beyond the outer wall and concrete support.

18. A system for removing water from between an inner wall and an outer wall comprising an inner wall, an outer wall, and a combination through-wall masonry flashing and drainage device, the device comprising a flashing membrane having a first side and a second side opposite the first side, a first reinforcing cloth adhered to the flashing membrane first side, a second reinforcing cloth adhered to the flashing membrane second side, and a wicking cloth adhered to the second reinforcing cloth; the device having a first edge and a second edge opposite the first edge, wherein the first edge of the device is secured to the inner wall with the wicking cloth facing up, and the second edge of the device is secured beyond the outer wall, such that water between the inner wall and outer wall is drawn through a mortar joint at the base of the outer wall to the outside of the outer wall by the wicking action of the wicking cloth without the need for vents.

19. The device of claim 1, wherein the flashing membrane is a sheet of PVC material.

20. The device of claim 1, wherein the flashing membrane is a sheet of polyethylene material.

21. The device of claim 1, wherein the flashing membrane is a sheet of stainless steel material.

* * * * *